United States Patent [19]

Miller

[11] Patent Number: 4,606,822

[45] Date of Patent: Aug. 19, 1986

[54] VORTEX CHAMBER AERATOR

[76] Inventor: Francis G. Miller, 3 Wild View Dr., Ligonier, Pa. 15658

[21] Appl. No.: 667,128

[22] Filed: Nov. 1, 1984

[51] Int. Cl.[4] ..... B01F 3/04

[52] U.S. Cl. ..... 210/221.2; 209/170; 209/211; 210/512.1; 261/76; 261/123; 261/DIG. 75

[58] Field of Search ..... 261/76, 121 R, 123, 261/79 A, DIG. 75; 209/166, 170, 164, 211, 144; 210/221.2, 512.1; 55/1, 419, 459 R, 459 A, 459 B

[56] References Cited

U.S. PATENT DOCUMENTS

| | | | |
|---|---|---|---|
| 755,430 | 3/1904 | Allington | 55/1 |
| 1,961,956 | 6/1934 | Bleibtreu et al. | 55/419 X |
| 2,005,305 | 6/1935 | Wagner | 55/419 X |
| 2,364,405 | 12/1944 | Trimbey et al. | 210/512.1 X |
| 2,653,801 | 9/1953 | Fontein et al. | 261/76 X |
| 2,767,840 | 10/1956 | Dobson et al. | 209/144 |
| 3,048,272 | 8/1962 | Miller | 209/166 |
| 3,400,818 | 9/1968 | Tarjan | 261/DIG. 75 |
| 3,507,397 | 4/1970 | Robinson | 209/211 X |
| 3,775,314 | 11/1973 | Beitzel et al. | 261/DIG. 75 |
| 4,067,814 | 1/1978 | Surakka et al. | 209/211 X |
| 4,086,306 | 4/1978 | Yoshinaga | 261/DIG. 75 |
| 4,090,956 | 5/1978 | Benzon | 209/211 |
| 4,341,630 | 7/1982 | Mackrle et al. | 210/221.2 |

FOREIGN PATENT DOCUMENTS

| | | | |
|---|---|---|---|
| 865405 | 9/1981 | U.S.S.R. | 209/170 |

*Primary Examiner*—Richard L. Chiesa
*Attorney, Agent, or Firm*—Harry B. Keck

[57] ABSTRACT

A vortex chamber aerator is provided with a split feed conduit whereby the liquid feed is introduced into the vortex chamber through two opposed passageways to provide more even distribution of the liquid currents within the vortex chamber. This results in reduced wear in the vortex chamber and more importantly presents a uniform discharge pattern of the liquid and entrained gas bubbles.

1 Claim, 7 Drawing Figures

VORTEX CHAMBER AERATOR

BACKGROUND OF THE INVENTION

1. Field of the Invention—The present invention relates to a vortex chamber and method for generating aqueous flotation froth.

2. Description of the Prior Art—Froth flotation is well known as a technique for separating minerals from gangue, for example, recovering selected oxides from mineral ores and separating combustible coal from slate. In the froth flotation process, air bubbles are formed beneath the surface of a vat containing an aqueous slurry of particles to be separated in the process. The slurry is agitated and the air bubbles rise to form a froth blanket above the liquid surface. Some of the particles are selectively adhered to the rising air bubbles and are recovered along with froth from the top of the vat. Other particles are withdrawn as an aqueous slurry from the bottom of the vat. In operation the vat requires a source of air bubbles and requires vigorous mechanical agitation of the liquid components of the vat accompanied by minimum agitation of the froth.

The mechanical agitation can be provided by rotating mechanical impellers, by pressurized injection of water or aqueous slurry beneath the liquid level of the vat or by other means (U.S. Pat. No. 3,048,272).

A vortex chamber has been proposed for creating mechanical agitation and generating appropriate air bubbles. Vortex chambers have been employed with success in froth flotation installations. Desirably the air bubbles should be of uniform size and should be distributed uniformly throughout the volume of the vat. Prior art vortex chambers consist of a cylindrical portion mounted above a conical portion having a bottom apex. An outlet is provided in the bottom apex. Water or aqueous slurry is introduced tangentially into the cylindrical portion where it swirls throughout the chamber and exits through the bottom outlet. An opening is provided in the top of the cylindrical portion to receive air which is sucked into the vortex chamber and is formed into small air bubbles as a result of the shearing action occurring as the water or aqueous slurry is forced at high velocities through the bottom opening. The vortex chamber is mounted securely in the central region of a froth flotation vat well below the liquid level of the vat. Another shortcoming of prior art vortex chambers is the directional thrust of the liquid agitation which they generate.

The swirling spray emitted from the bottom opening of the prior art vortex chambers is not uniform around the circumference and consequently the weak side of the spray permits air to escape unsheared, particularly when the shearing capability of the strong side of the spray is approached. Alternatively if the amount of air in the system is restricted to shearing capacity of the weak side of the spray, much of the air shearing capacity of the strong side is unused.

The exiting water or aqueous slurry enters into the vat in a radially outward direction away from the vortex chamber establishing undesirable directional currents within the liquid inventory of the vat. As an example, the single inlet vortex chamber develops an outlet spray which is non-uniform, with the heaviest concentration appearing approximately 270 degrees beyond the inlet. Because of this non-uniformity of slurry flow from the bottom of the vortex chamber, the escaping, unsheared or partially sheared air from the weak side of the device can create a boiling action within the vat at differing locations.

STATEMENT OF THE INVENTION

According to the present invention, a vortex chamber is provided for aerating and agitating aqueous slurry in a froth flotation installation. The vortex chamber provides generally uniformly distributed outwardly moving streams of agitating liquid which are generally uniformly assimilated in the froth flotation vat without creating objectionable swirling movements of the liquid inventory of the vat. In addition, the present invention provides a uniform distribution of air bubbles over the entire cross-section of the vat rather than the uneven air bubble distribution observed with prior art vortex chambers. Further, the size uniformity of the air bubbles can be controlled to optimize froth flotation separation.

The present invention accomplishes these benefits by providing a split inlet for the water or aqueous slurry which is the liquid supplying the kinetic energy required to drive and feed the vortex chamber. Specifically, water or aqueous slurry is introduced into a feed conduit having appropriate splitter means to divide the feed liquid into two separate streams which are introduced into the vortex chamber through opposed side wall openings in the cylindrical side wall. One stream is introduced tangentially into the vortex chamber in a first side wall opening. The other stream moves in a generally circular path around the outer side wall of the cylindrical portion of the vortex chamber and enters into the vortex chamber through a second side wall opening which is opposed to the first side wall opening. The kinetic energy of the liquid feed stream is introduced as two streams within the cylindrical chamber. As a result, the bottom effluent liquid exiting from the outlet is more uniformly directed outwardly from the vortex chamber across the bottom portion of the vat whereby objectionable swirling liquid currents are avoided. The shearing action occurring at the bottom outlet appears to be more uniform whereby the resulting air bubbles have a more uniform size and are discharged from the vortex chamber in a more uniform circular pattern.

In a further embodiment, a conical skirt or shroud is provided at the base of the vortex chamber with the upper apex end secured annularly of the bottom opening of the vortex chamber. The open base of the skirt confronts the bottom of the container for the froth flotation installation and improves the distribution of air bubbles and agitating liquid over the area of the container. Preferably the skirt is provided with multiple perforations to permit air bubbles to rise upwardly through the skirt.

In a further embodiment, means are provided for introducing additional air beneath the skirt annularly of the bottom apex opening of the vortex chamber.

DESCRIPTION OF THE PREFERRED EMBODIMENTS

Figure 1:
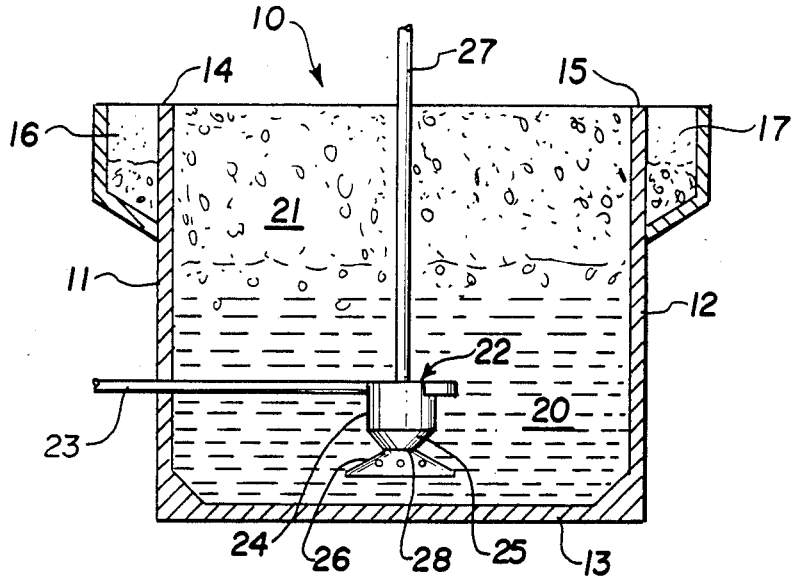
FIG. 1 is a schmatic illustration of the vortex chamber of this invention positioned in the lower portion of a froth flotation vat.

FIG. 1 illustrates a typical froth flotation cell 10 including vertical side walls 11, 12, a bottom wall 13 and overflow rims 14, 15. A froth collection channel 16, 17 is provided along each side of the vat 10 to collect overflowing froth. It will be observed that there is a liquid inventory 20 in the base of the vat 10 and a froth blanket 21 above the liquid inventory 20.

A vortex chamber 22 is positioned in the lower portion of the liquid inventory 20 and includes a liquid feed conduit 23, a cylindrical portion 24, a conical portion 25 and preferably a conical skirt 26 provided with plural perforations. An air inlet conduit 27 is provided to supply air or other gas that can be sheared into gas bubbles for froth formation. Water or aqueous slurry is introduced into the vortex chamber 22 through the feed conduit 23. The water or aqueous slurry swirls through the cylindrical portion 24 and the conical portion 25 and discharges through a bottom apex opening 28 of the conical portion 25 beneath the conical skirt 26. The swirling action of the liquid within the vortex chamber 22 reduces the pressure and aspirates air from the conduit 27. Air and liquid discharged from the vortex chamber 22 create a multitude of small air bubbles which rise in part through the perforations of the conical skirt 26 and in part by flowing around the edges of the conical skirt 26 and thence outwardly and upwardly to form a froth blanket 21 at the top of the liquid. The high velocity slurry discharge from the base of the vortex chamber and the outward movement of the slurry from the base of the conical skirt 26 creates turbulence, eliminates sanding and improves mixing of the slurry particles within the liquid inventory 20.

Figure 2:
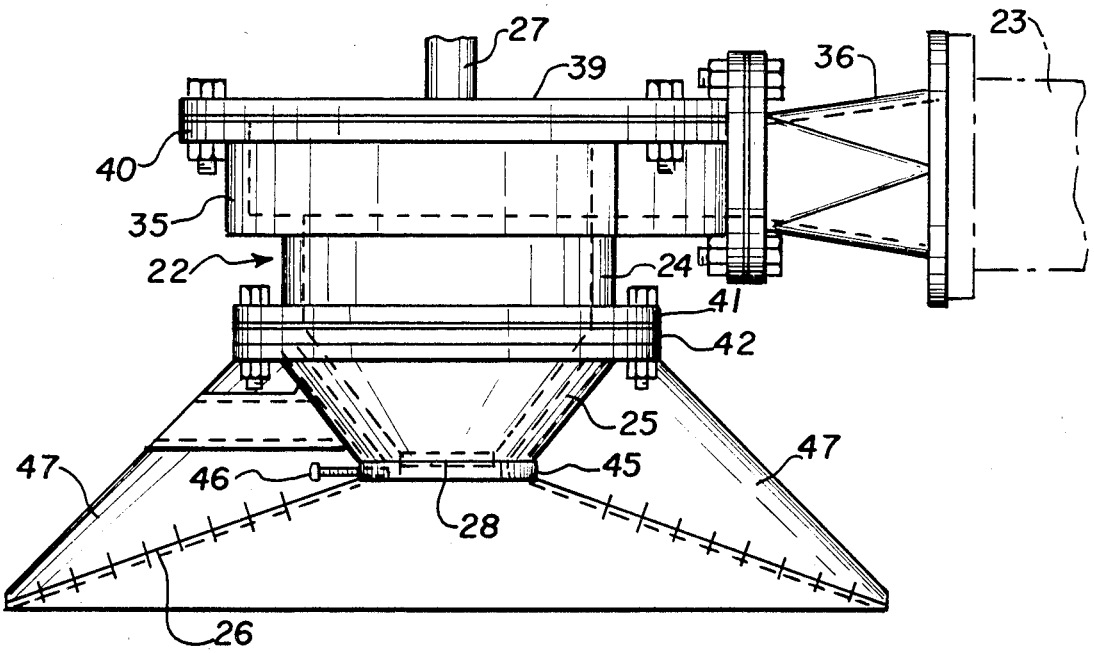
FIG. 2 is a side elevation of the vortex chamber of the invention.
Figure 3:
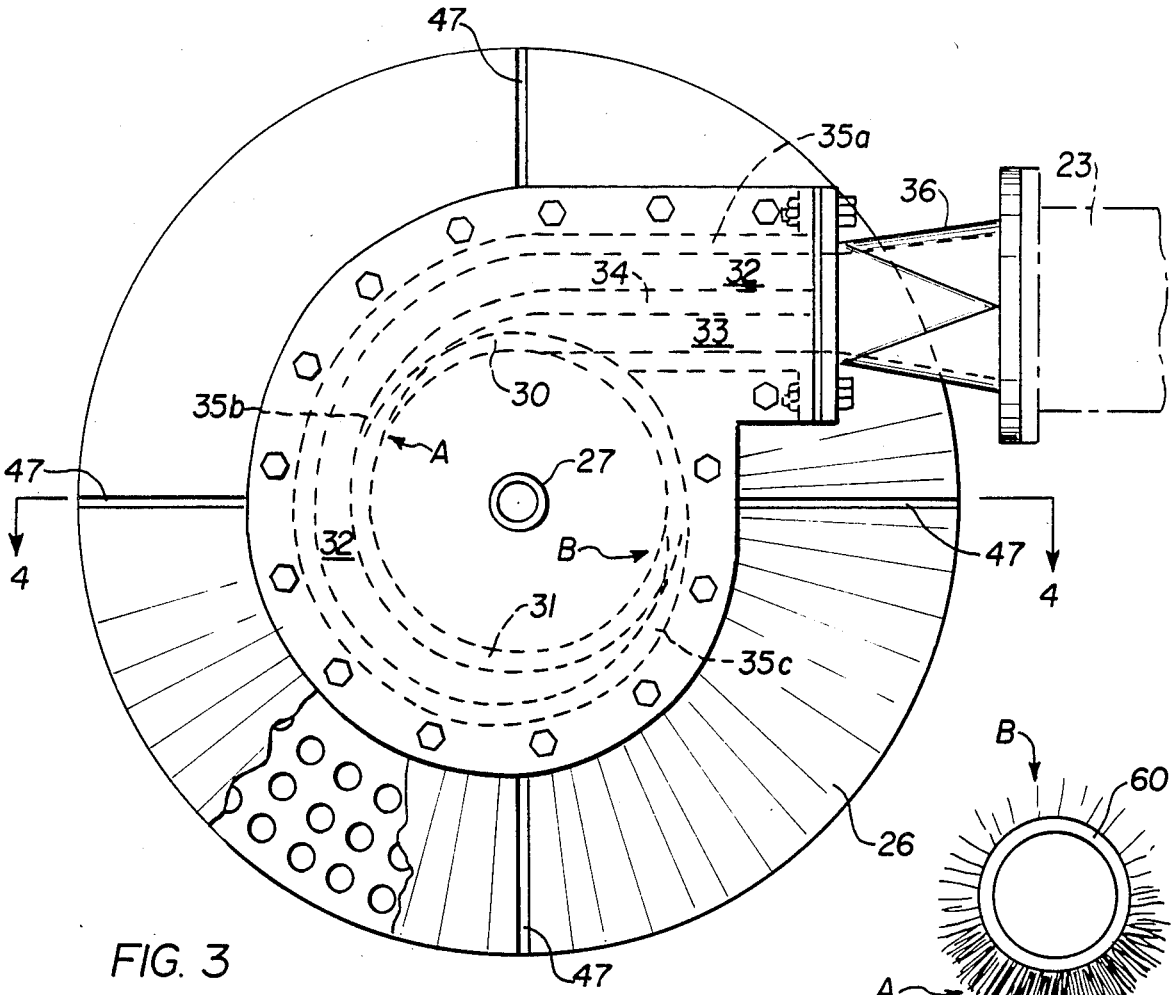
FIG. 3 is a plan view of the vortex chamber of FIG. 2.
Figure 4:
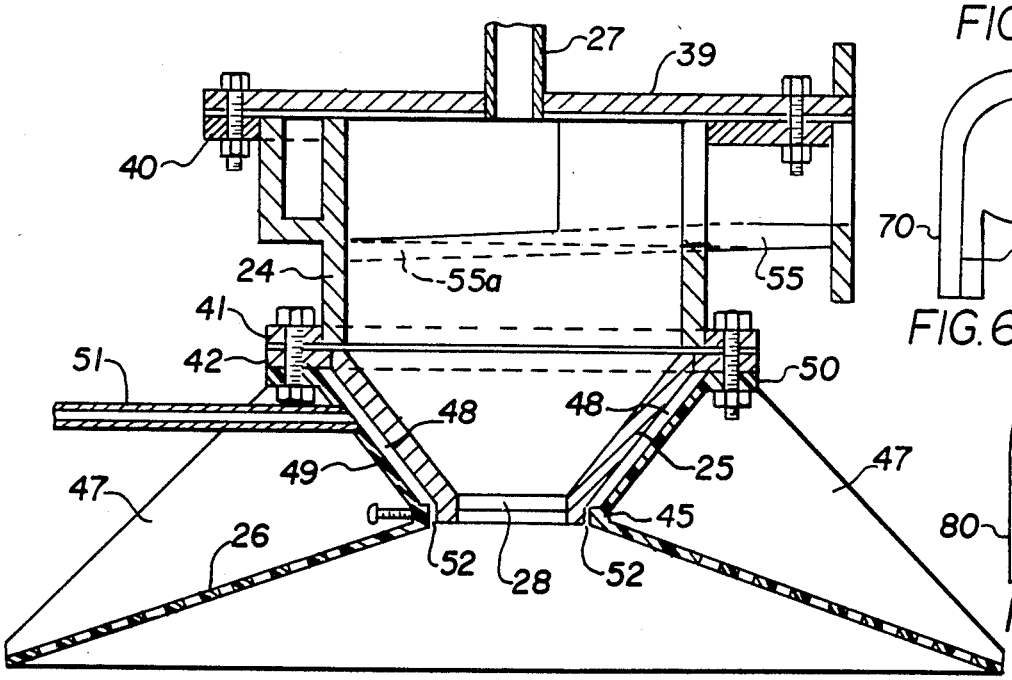
FIG. 4 is a sectional illustration of the vortex chamber taken along the plane 4—4 of FIG. 3.

As shown in FIGS. 2, 3, 4, a vortex chamber 22 includes a cylindrical portion 24, conical portion 25, a conical skirt 26 and an air inlet conduit 27.

The cylindrical portion has two side wall openings 30, 31 which receive incoming water or aqueous slurry through a pair of feed passageways 32, 33 which are horizontally separated by a vertical wall 34. The wall 34 is arcuate near the vortex chamber 22 and tangentially merges with the cylindrical surface of the cylindrical portion 24 at A (FIG. 3). The first fluid passageway 33 delivers water or aqueous slurry through the first side wall opening 30. The fluid passageway 32 travels around the outer surface of the cylindrical portion 24 and delivers water or aqueous slurry through the second side wall opening 31. The outer wall 35 of the second passageway 32 is straight in the region 35*a*, is a cylindrical surface in the region 35*b*, and terminates in an arcuate surface 35*c* which tangentially merges with the cylindrical wall of the cylindrical portion 24 in the region identified by B (FIG. 3). It will be observed that the side wall openings 30, 31 are in part diametrically opposed. Preferably each fluid passageway has a rectangular composition.

A transition piece 36 is provided to accomplish a change in the cross-section of the flow area of the water or aqueous slurry from a feed conduit 23 into the two passageways 32, 33. The vertical wall 34 constitutes a splitter means for dividing the incoming liquid feed into two separate streams which are individually introduced tangentially into the interior of the cylindrical portion 24. The splitter means is the wall section 34 which comprises one wall of the first passageway 33 and one wall of the second passageway 32. Each of the two streams enters the cylindrical chamber 24 tangentially to the side wall and each stream develops a separate circular swirling movement through the cylindrical portion 24 and is discharged through the conical bottom portion 25 through the apex opening 28. In a preferred embodiment, each of the passageways 32, 33 has an axis which is an involute spiral of the vertical axis of the cylindrical chamber 24.

The swirling movement of the liquid within the cylindrical section 24 creates a reduced pressure which aspirates gas, normally air, from the air conduit 27 into the interior of the vortex chamber 22. Air and the water or aqueous slurry is discharged through the apex opening 28 at high velocity whereby strong shearing stresses are developed to generate small, uniformly sized air bubbles which will form the required froth.

The cylindrical portion 24 is provided with a cover plate 39 which may be bolted to an upper flange 40 of the cylindrical portion 24. The cylindrical portion 24 may be secured to the conical portion 25 by connections between confronting flanges 41, 42.

A conical perforated skirt or shroud 26 is secured by an appropriate mechanical connection such as a collar 45 and screw 46 about the outer wall of the apex opening 28. The skirt or shroud 26 is provided with plural perforations to permit gas bubbles to rise upwardly therethrough. Preferably the shroud is fabricated from a plastic substance such as laminates of fiber reinforced plastics such as unsaturated polyesters, polyurethanes, natural or artificial rubber and the like. Appropriate stiffening gussets 47 are provided between the top surface of the conical skirt 26 and the conical wall of the conical portion 25. The base of the conical skirt 26 confronts the bottom wall 13 (FIG. 1) and directs the incoming water or slurry over the entire area of the liquid inventory 20.

In a further embodiment, best seen in FIG. 4, a conical annular chamber 48 is provided and is formed by a conical surface 49 extending from the collar 45 to a circular flange 50 which abuts the flange 42. The conical annular chamber 48 serves as a manifold chamber for a supplemental supply of air which is introduced into the annular chamber 48 through an appropriate air conduit 51. Additional froth bubble forming air can be introduced into the liquid inventory of the froth flotation vat through one or more air ports 52 presented in a circular locus about the outer wall of the bottom apex 28. The incoming air is thus introduced annularly of the bottom apex 28 and beneath the skirt 26.

A further improvement in the vortex chamber of this invention is illustrated in FIG. 4 where the two fluid passageways 32, 33 enter into the cylindrical chamber 24 at slightly different vertical elevations. The fluid passageways 32, 33 have a bottom wall 55 which descends in a helix at a uniform slope between the inlet flange 56 and the second sidewall opening 31. The lower level of the bottom wall 55*a* is clearly seen in FIG. 4. As a result of a modest lowering of the entry level of the second passageway, the maintenance of two swirling liquid patterns within the vortex chamber is facilitated.

EXAMPLE

In a typical example, a vortex chamber 22 is formed from steel and the skirt 26 and the supporting gussets 47 are formed from resilient plastic substances such as glass fiber reinforced unsaturated polyester materials or polyurethane materials or natural or synthetic rubber materials and the like. The cylindrical chamber 24 typically has a diameter of about 8 to 20 inches, preferably about 12 inches, and a height of about 6 to 10 inches. The conical chamber 25 has a major diameter corresponding to that of the cylindrical chamber 24 and has an apex opening 28 from about 2 to 5 inches. The height of the conical frustum is from 4 to 8 inches. The major, base diameter of the skirt 26 is about 1.5 to 5 times the diameter of the cylindrical chamber 24 and preferably is about 2.5 to 5 feet. The slope of the conic section of the skirt is preferably from about 10 to 20 degrees. The perforations in the skirt comprise about 30 to 50% of the total surface area of the skirt 26 and are preferably distributed over the major portion of the skirt and have diameters of ½-inch to 1.0-inch.

A vortex chamber having a cylindrical chamber 24 of about 12 inches diameter can receive water or aqueous slurry feed stock from a 6-inch I.D. feed conduit 23.

Figure 5:
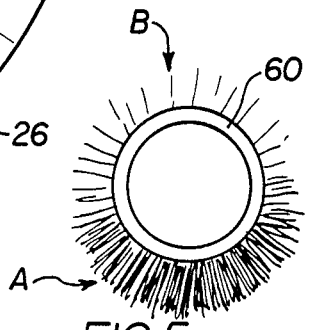
FIG. 5 is a sketch of a non-uniform air bubble distribution pattern as seen from beneath a vortex chamber outlet.

FIG. 5 illustrates a typical air bubble distribution pattern from the apex opening of a vortex chamber having a single feed conduit. The vortex opening 60 receives a non-uniform discharge stream with the result that the discharge on one side A is greater than the discharge on the other side B. The non-uniform liquid discharge creates a concentration of air bubbles in the region A and a shortage of air bubbles in the region B. More importantly, the stronger movement of the stream in the region A sets up swirling patterns within the vat causing undesirable movement. The amount of air which can be introduced into the system through the apex opening 60 is limited to that which will be sheared in the opening 60 and released in the region B. If the operator attempts to introduce additional air or to increase the air pressure, then larger bubbles will appear in the region B which will rise upwardly and create surface ebullition and eruptions which are undesirable.

By practicing the present invention, the distribution pattern of air bubbles released from the apex opening 60 is uniform around the periphery thus permitting increased air introduction and consequent increased bubble formation.

Figure 6:
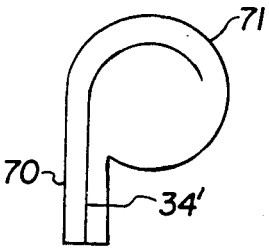
FIGS. 6 and 7 are schematic views of alternative communications of a feed conduit and a vortex chamber.
Figure 7:
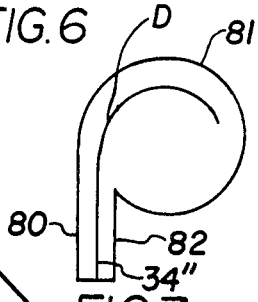

FIGS. 6 and 7 illustrate alternative communications between a feed conduit and the cylindrical body portion of a vortex chamber. The feed conduits 70, 80 (FIGS. 6, 7 respectively) are introduced tangentially to the cylindrical body portion 71, 81 of FIGS. 6, 7 respectively. It will be observed that the central vertical wall 34' of the feed conduit 70 is tangential to the wall of the cylindrical body portion 71. On the other hand, the proximate feed conduit wall 82 in FIG. 7 is tangential to the cylindrical wall of the cylindrical body portion 81. In this embodiment, the vertical central wall 34" is curved toward the cylindrical body portion 81 in the region indicated by the letter D in FIG. 7.

The vertical central wall 34 (34', 34") preferably is fabricated from metal such as steel and particularly high nickel content steel. Alternatively the vertical central wall may be fabricated from wear-resistant ceramic such as silicon carbide, alumina, silica-alumina and the like. Since the vertical central wall 34 (34', 34") functions as a feed splitter, it may be desirable that the forward edge of the vertical central wall have a knife edge configuration.

I claim:

1. In a froth flotation tank having a vortex chamber for aerating and agitating an aqueous slurry and delivering a uniformly dispersed spray of gas bubbles in said aqueous slurry into said froth flotation tank, the combination of a generally cylindrical vortex chamber communicating at its base with a conical chamber, an outlet at the bottom apex end of said conical chamber, an inlet in the upper portion of said cylindrical chamber to receive gas, a single slurry feed conduit, splitter means within said feed conduit for dividing the cross-sectional area of said conduit into a first generally horizontal passageway and a second generally horizontal passageway, said passageways being side-by-side and directed toward the said cylindrical chamber, a single first side wall opening in said cylindrical chamber communicating tangentially with said first passageway, a single second side wall opening in the said cylindrical chamber remote from said first side wall opening, said second passageway extending arcuately outside said upper portion of said cylindrical chamber an communicating tangentially with said second side wall opening, whereby said aqueous slurry enters into said conical chamber without interruption.

* * * * *